United States Patent [19]

Yamashita et al.

[11] 4,324,088

[45] Apr. 13, 1982

[54] REFUSE STORAGE APPARATUS WITH SEALER FOR SEALING PLIABLE BAG TOP

[75] Inventors: Kiyoshi Yamashita, Aichi; Shoji Takagi, Toyoake, both of Japan

[73] Assignee: Tokyo Shibaura Denki Kabushiki Kaisha, Kawasaki, Japan

[21] Appl. No.: 100,379

[22] Filed: Dec. 5, 1979

[30] Foreign Application Priority Data

| | | | |
|---|---|---|---|
| Dec. 22, 1978 | [JP] | Japan | 53-162992 |
| Dec. 22, 1978 | [JP] | Japan | 53-81473[U] |
| Jan. 11, 1979 | [JP] | Japan | 54-2291[U] |
| Jan. 18, 1979 | [JP] | Japan | 54-5730[U] |

[51] Int. Cl.[3] ..... B65B 3/00; B65B 61/24

[52] U.S. Cl. ..... 53/527; 4/484; 4/655; 53/570

[58] Field of Search ..... 53/436, 479, 526, 527, 53/570, 390; 4/315, 484, 629, 655, 639, 652, 638, 653

[56] References Cited

U.S. PATENT DOCUMENTS

| | | | |
|---|---|---|---|
| 2,041,187 | 5/1936 | Janda | 4/484 |
| 2,144,634 | 1/1939 | Murch | 53/527 X |
| 2,172,188 | 9/1939 | Cather | 4/629 |
| 2,481,611 | 9/1949 | Moore | 53/526 |
| 2,524,204 | 10/1950 | O'Brien | 4/629 |
| 3,347,013 | 10/1967 | Razze | 53/479 X |
| 3,401,409 | 9/1968 | Ekrut | 4/484 |
| 3,471,990 | 10/1969 | Bonuchi | 53/526 |
| 3,488,915 | 1/1970 | Delestatius | 53/526 X |
| 3,516,217 | 6/1970 | Gildersleeve | 53/436 X |
| 3,619,822 | 11/1971 | Carmichael | 4/484 |
| 3,659,427 | 5/1972 | Harza | 53/527 X |
| 3,780,488 | 12/1973 | Herrell | 53/479 |
| 3,792,565 | 2/1974 | Goransson | 53/390 X |
| 3,832,738 | 9/1974 | Kueman | 4/484 X |
| 3,882,771 | 5/1975 | Frohbieter | 53/527 X |
| 3,935,692 | 2/1976 | Miller | 53/527 X |
| 4,014,154 | 3/1977 | Lerner | 53/479 X |

FOREIGN PATENT DOCUMENTS

| | | | |
|---|---|---|---|
| 2311252 | 4/1974 | Fed. Rep. of Germany | 53/436 |
| 558388 | 1/1944 | United Kingdom | 4/629 |

*Primary Examiner*—John Sipos

*Attorney, Agent, or Firm*—Cushman, Darby & Cushman

[57] ABSTRACT

A refuse storage apparatus comprising a hopper having an opening, a frame mounted under the hopper cooperating with the opening to form a recess for receiving a pliable bag, and a sealer located adjacent the top of the recess for sealing at least an upper portion of the pliable bag.

1 Claim, 10 Drawing Figures

FIG. 7
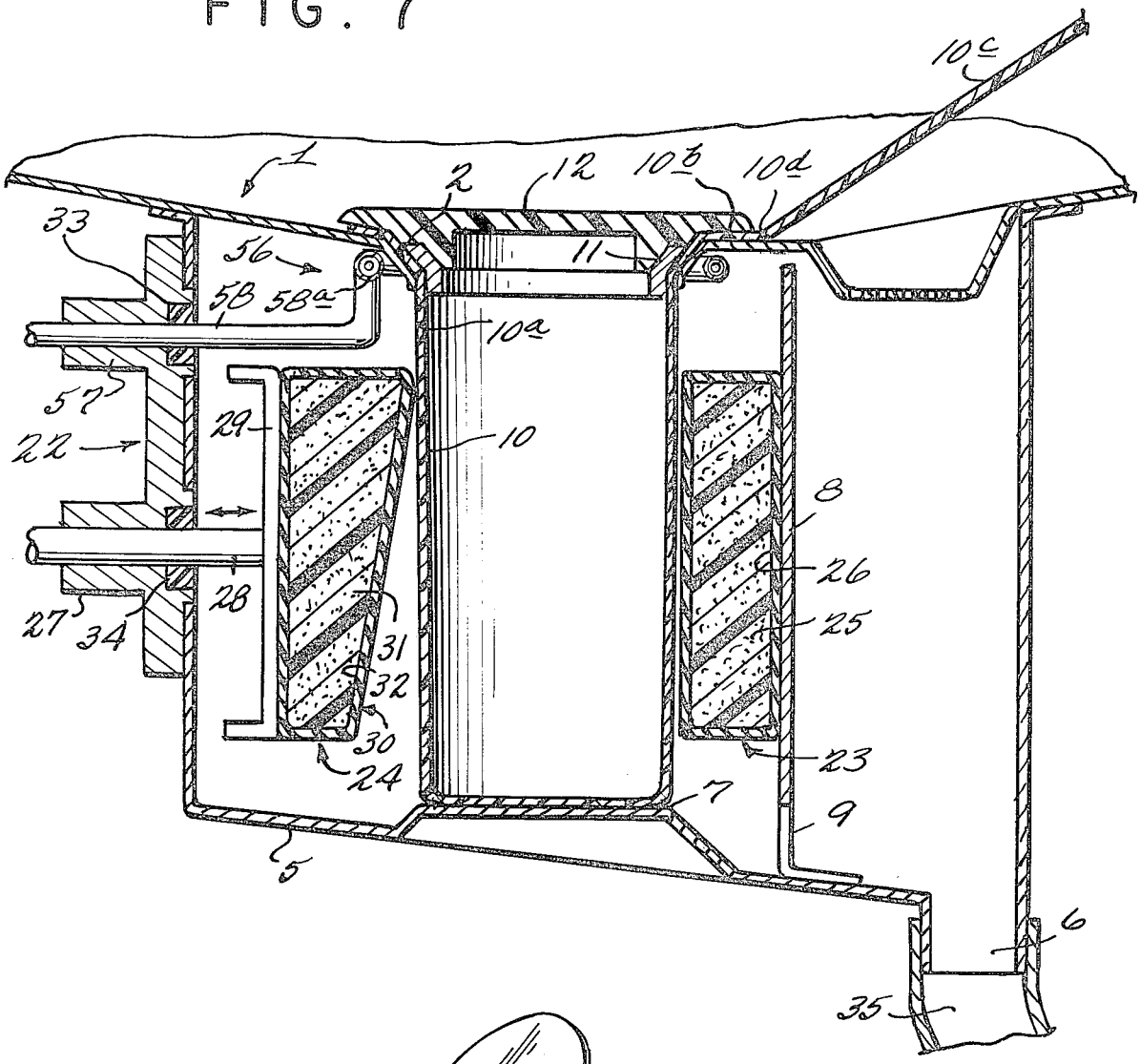
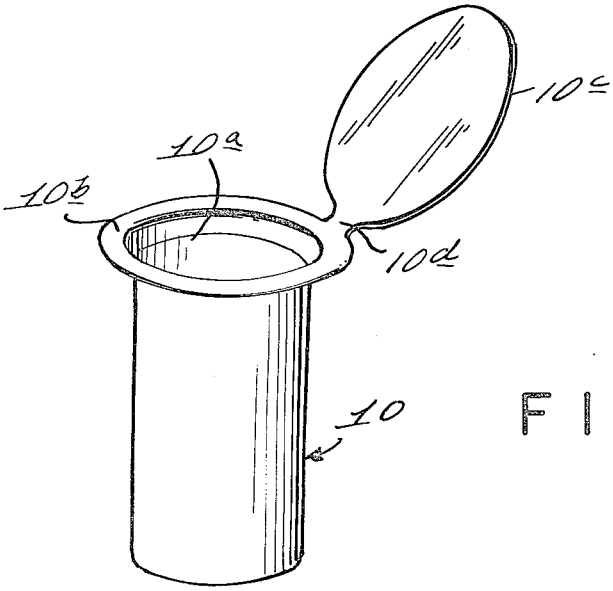
FIG. 8

FIG. 9
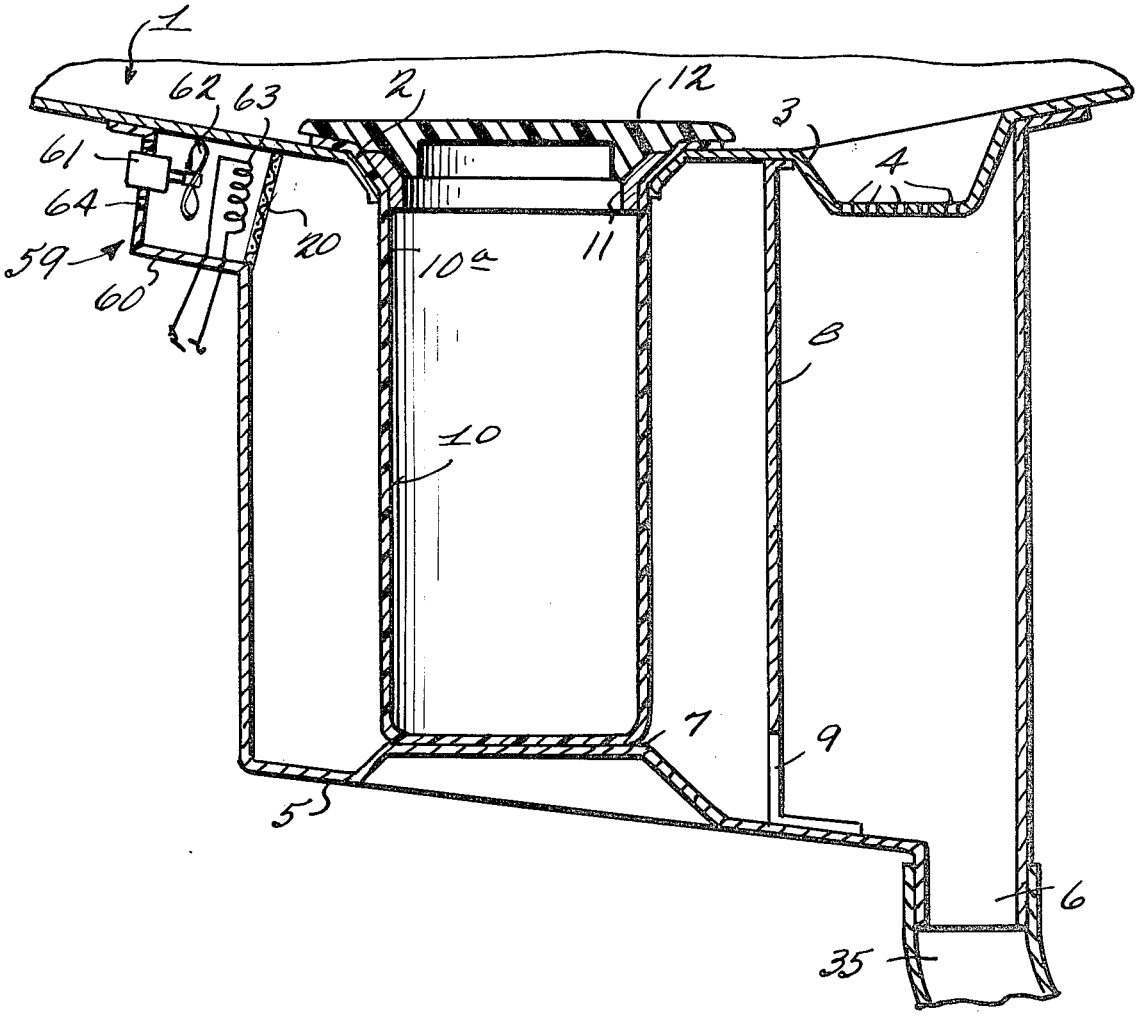
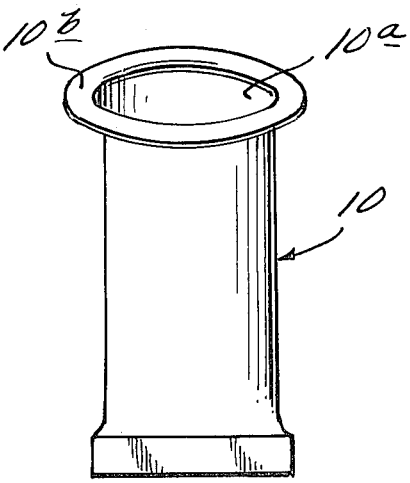
FIG. 10

REFUSE STORAGE APPARATUS WITH SEALER FOR SEALING PLIABLE BAG TOP

This invention relates to a refuse storage apparatus and more particularly to an improvement in the sealing of a pliable bag which stores refuse therein.

Recently, many kinds of refuse storage apparatus have been developed. However, the prior refuse storage apparatus usually used for storing kitchen garbage, are not designed for placement in the sink so that the garbage which comes out from washing tableware, vegetables and so on must be carried to the refuse storage apparatus by some other receptacle.

Another problem with prior devices is smell because the garbage is transferred twice from the sink to the receptacle and from the receptacle to the refuse storage apparatus.

Sanitation is another problem because a part of garbage remains in the refuse storage apparatus.

Accordingly, it is an object of this invention to provide a refuse storage apparatus which is improved in operation, odorless and clean.

This invention relates to a refuse storage apparatus adapted to be placed in a hopper having an opening. A lid is placed to cover the opening and after washing is finished the lid is removed. The refuse is put into a pliable bag which is placed in a recess formed by a frame beneath the opening and which is supported at its top portion by an edge of the opening of the hopper. The bag is sealed by a sealer at at least its upper portion, and can be compacted as well.

This invention can be more fully understood from the following detailed description when taken in conjunction with the accompanying drawings.

FIG. 1 to FIG. 7 are sectional views of a refuse storage apparatus according to the first to the seventh embodiments of this invention; FIGS. 4–6 being partial views;

FIG. 8 is a perspective view of a pliable bag adapted to the seventh embodiment;

FIG. 9 is a fragmentary sectional view of a refuse storage apparatus according to the eighth embodiment of the invention;

FIG. 10 is a perspective view of a pliable bag adapted to the first to the sixth embodiments.

Figure 1:
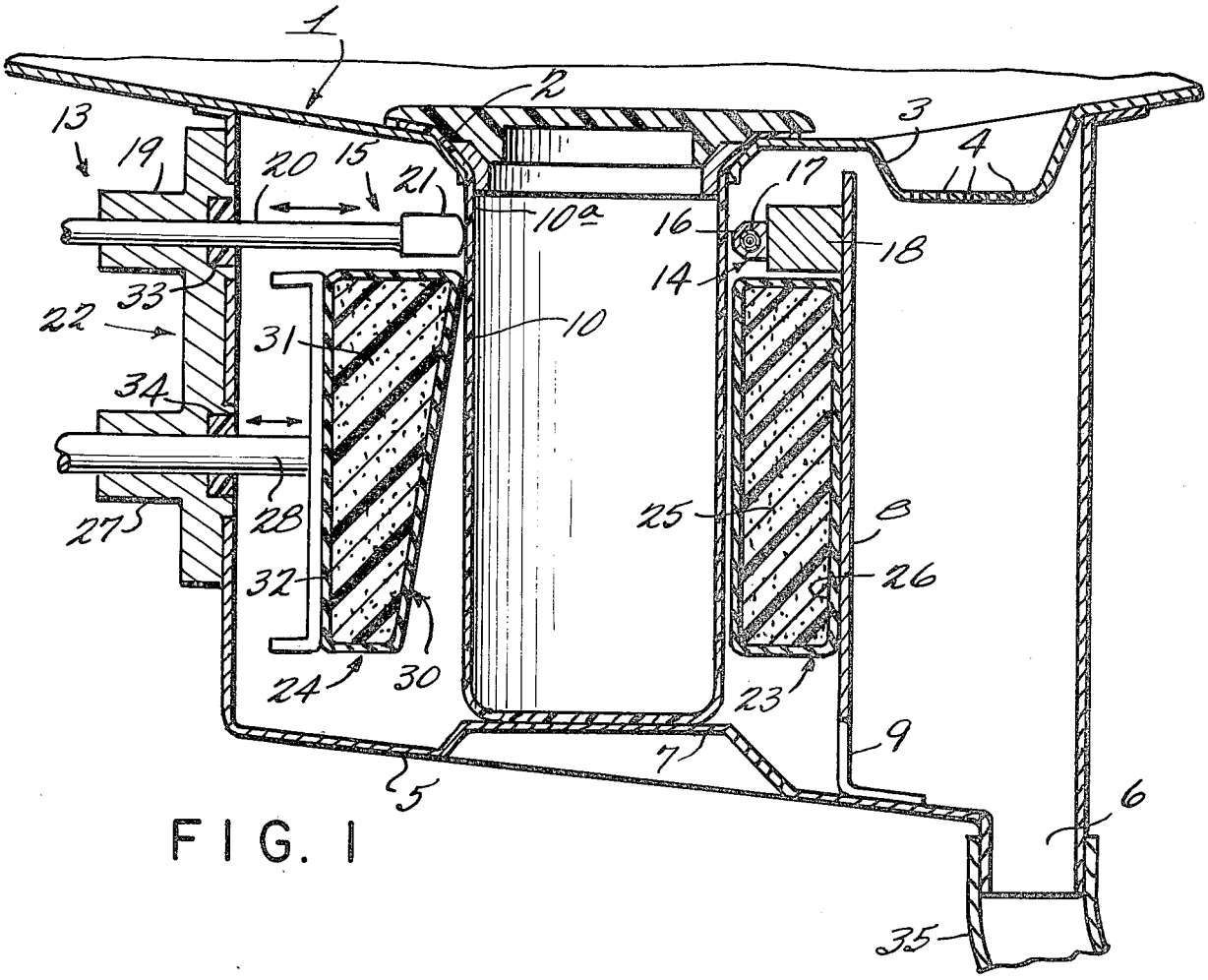

Now there will be described a first embodiment of this invention according to FIG. 1.

Hopper 1, which may be part of a conventional kitchen sink, has an opening 2 and an adjacent indented portion 3. Portion 3 has a drain holes 4 in it's bottom for draining liquids. A box shaped frame 5 is mounted under hopper 1 defining a recess with a first section under opening 2 and second section under drain holes 4. A drain opening 6 and a projection surface 7 both are formed in the bottom of frame 5, the surface of which otherwise inclines toward drain opening 6. Drain opening 6 is located roughly beneath drain holes 4 and projection 7 is located beneath opening 2. A separating plate 8 is secured on the bottom of frame 5 between the two sections to separate opening 2 from portion 3 and has a perforation 9 at a lower portion thereof for permitting liquid to flow therethrough to opening 6.

A pliable bag 10 is made of synthetic resin, e.g. polyethylene or vinyl chloride, and has a thickness of about 0.2 mm to 0.3 mm to keep a cylindrical form. Pliable bag 10 is detachably supported at its top portion 10*a* to be caught between opening 2 and a ring shaped bag holder 11 to communicate opening 2 of hopper 1 with the opening of top portion 10*a*. The bottom of bag 10 rests on projection 7. A lid 12 is detachably supported by hopper 1 to close opening 2.

Adjacent the top of the recess is a sealer 13 for sealing at least the top. Sealer 13 includes a heating unit 14 and a presser 15. Unit 14 includes a sheathed electric heater 17 molded into a heating block 16 which is made of heat conductive material. Unit 14 is mounted on the upper portion of plate 8 outside of bag 10 by supporting block 18. Presser 15 is made up of a sliding rod 20 and a pressing block 21. Block 21 is made of heat conductive material and is secured to the tip of sliding rod 20. Sliding rod 20 is slidably supported to a first bearing 19 which is secured to the side wall of frame 5 opposite to unit 14. The end of rod 20 remote from block 21 can be accessible outside the hopper (not shown) for manual operation to effect sealing or alternatively automatic structure can be provided to cause movement by manual operation of an appropriate control. Inward movement of rod 20 presses the bag between unit 14 and block 21 so that the bag is sealed in the region of heating.

A compressor 22 is also provided for compacting the contents of bag 10, and includes a fixed elastic receiving pad 23 and a movable compressing block 24. Pad 23 consists of a flexible block 25 covered with a rubber sheet 26, and is secured to supporting plate 8 below unit 14. Compressing block 24 includes a compressing rod 28 which is slidably supported by a bearing 27 mounted on frame 5. A block 30 is secured to a pedestal 29 mounted on the tip of compressing rod 28. Block 30 consists of a spongy block 31 covered with a rubber sheet 32 and has a trapezoidal shape in cross section. Then, block 30 is able to press and move bag 10 toward pad 23 by sliding compressing rod 28. Rod 28 may be manually or automatically operated in the same way as rod 20. Mechanical seals 33 and 34 are secured to bearing 19 and bearing 27 respectively, and drain hose 35 is connected to drain opening 6 in frame 5.

The operation of this invention is as follows. In FIG. 1, pliable bag 10 is placed on projection 7 and is supported at it's top portion 10*a* by the edge of opening 2 and bag holder 11, and opening 2 is detachably covered by lid 12. When the operator washes vegetables or tableware on hopper 1, for example in the kitchen sink, water flows out to drain hose 35 from drain opening 6 through drain holes 4, and garbage remains on hopper 1. Then, opening 2 is opened by removing lid 12 from opening 2, and the garbage placed into pliable bag 10 through opening 2.

After that, compressing rod 28 is moved toward receiving pad 23, so that pliable bag 10 and the garbage in pliable bag 10 are compressed by compressing block 30. Accordingly, the air and the water in pliable bag 10 are pressed out from opening 2 and the garbage is pressed to the lower portion of pliable bag 10, so that pliable bag 10 will become compact.

After the bag has been filled or disposal is desired for other reasons, electric heater 17 is energized to heat block 16. Sliding rod 20 now moves inwardly pushing portion 10*a* against heating block 16 so that the top portion 10*a* of pliable bag 10 is sealed by the heat from rod 16. After sliding rod moves back to its initial position, bag holder 11 is removed from opening 2 of hopper 1. After this, pliable bag 10 filled with garbage is taken out from the recess through opening 2 and thrown away at some suitable place. A fresh pliable bag 10 is now placed to be connected to hopper 1 by supporting at its top portion 10*a* with bag holder 11 and opening 2, and covering opening 2 by lid 12.

In the foregoing first embodiment, pliable bag 10 is placed to be connected to hopper 1, so that all of the garbage on hopper 1 can be put into bag 10 without transfer of the garbage to another receptacle. Thus the time required to transfer the garbage is saved and hopper 1 is kept clean. Smell of the garbage is reduced and sanitation improved because upper portion 10*a* of bag 10 is sealed by sealer 13.

A further advantage of the first embodiment is that the capacity of pliable bag 10 to contain garbage is increased by compressor 22. More particularly, the shape or hardness of the garbage does not effect operation because receiving pad 23 and compressing block 30 are made of a spongy material covered with a rubber sheet.

Figure 2:
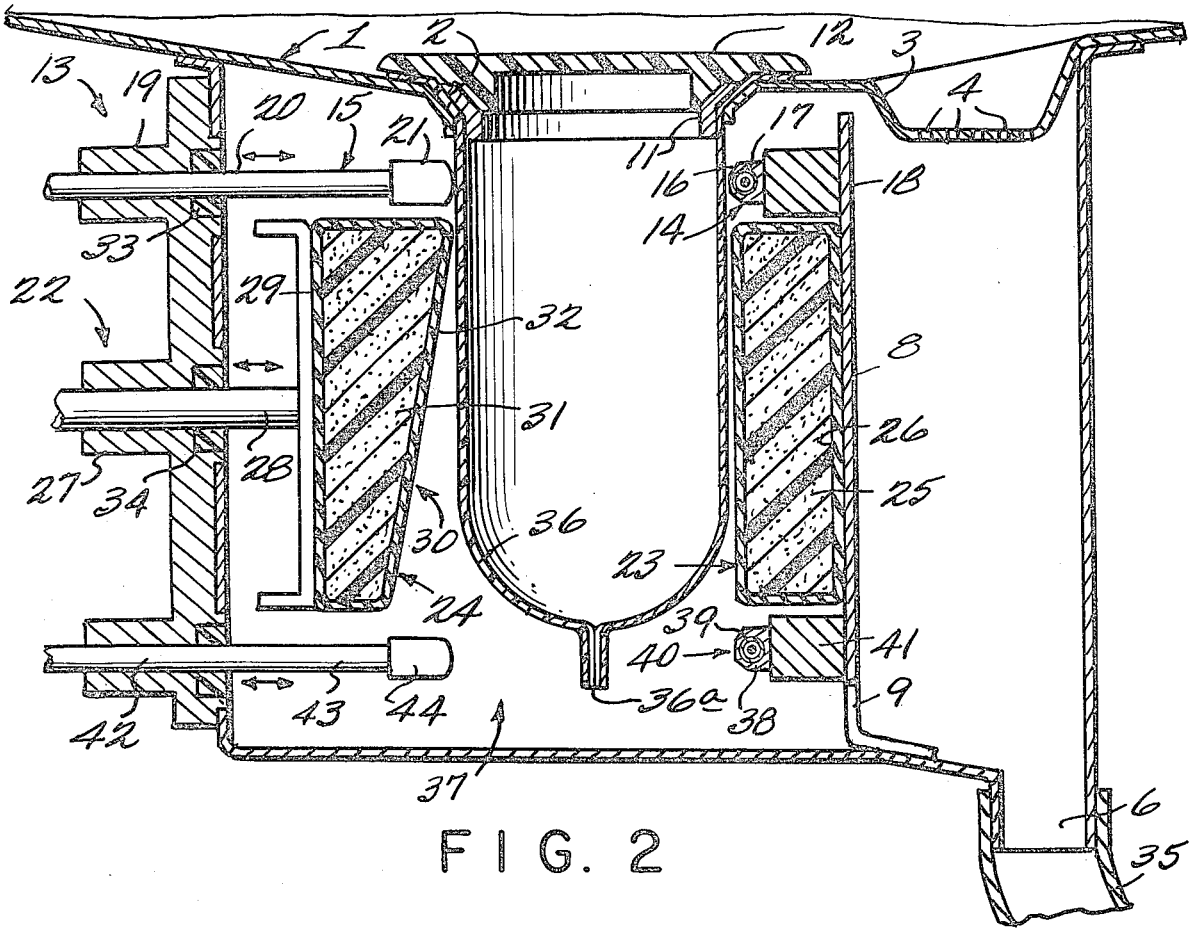

FIG. 2 shows a second embodiment of this invention. In this embodiment a pliable bag 36 which is used has a drain hole 36*a* and an auxiliary sealer 37 which is secured to frame 5. Drain hole 36*a* is perforated at the bottom portion of pliable bag 36 as it is difficult to drain the water or the air in pliable bag 36 when it is compressed by compressing means 22. Auxiliary sealer 37 consists of a heating unit 40 which includes sheathed heater 39 molded into a heating block 38, a supporting block 41 which supports heating unit 40 to the lower portion of separating plate 8, a third bearing 42 which is secured to the lower side wall of frame 5, a sliding rod 43 which is slidably supported to the third bearing and a pressing block 44 which is secured to the tip of sliding rod 43. In the same way as rod 20, rod 43 is moved toward heating unit 40 and pinches bag between rod 43 and heating unit 40. In the foregoing second embodiment, drain hole 36*a* of pliable bag 36 is sealed by auxiliary sealer 37 after the water or the air in bag 36 are drained from drain hole 36*a*.

Figure 3:
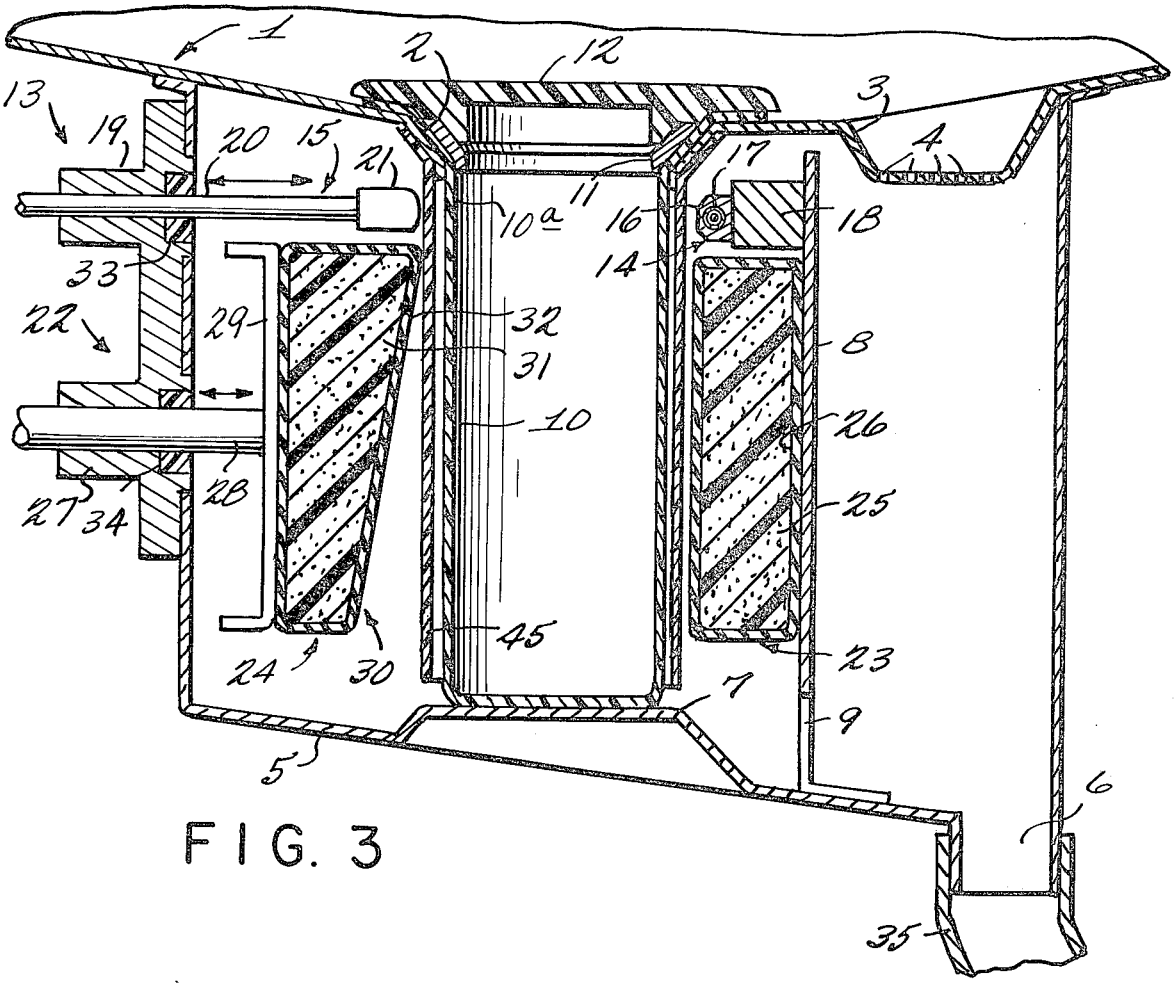

FIG. 3 shows a third embodiment of this embodiment. In this embodiment, the top portion of an elastic deformable tube 45 is secured under hopper 1 and surrounds pliable bag 10, so that frame 5, sealer 13 and compressor 22 are not soiled by the garbage or the dirty water even if the operator forgets to insert and set pliable bag 10 or even if pliable bag 10 is broken.

Figure 4:
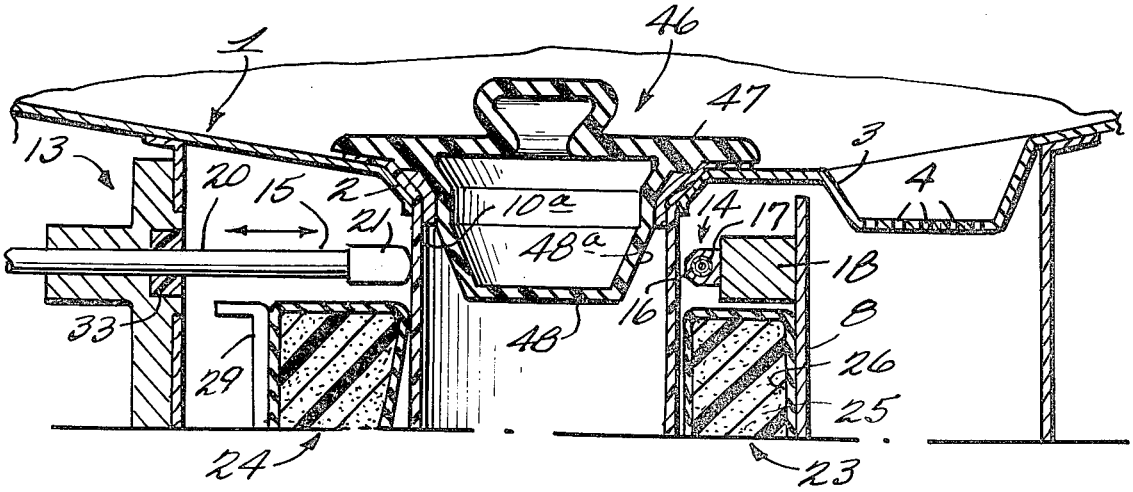

FIG. 4 shows a fourth embodiment of this invention. In this embodiment, a compactor 46 is detachably mounted to top portion 10*a* of pliable bag 10. Compactor 46 is molded together with lid 47 which corresponds to lid 12 of the first embodiment. Compactor has a compacting portion 48 which is trapezoidal shaped for compacting the garbage in pliable bag 10. When pressing means 15 is operated and pressing block 21 presses compactor 46, pressing block 21 presses the inclined guide surface 48 of compactor 46, so that compactor 46 is urged upwardly away from the locus of sliding rod 20.

Figure 5:
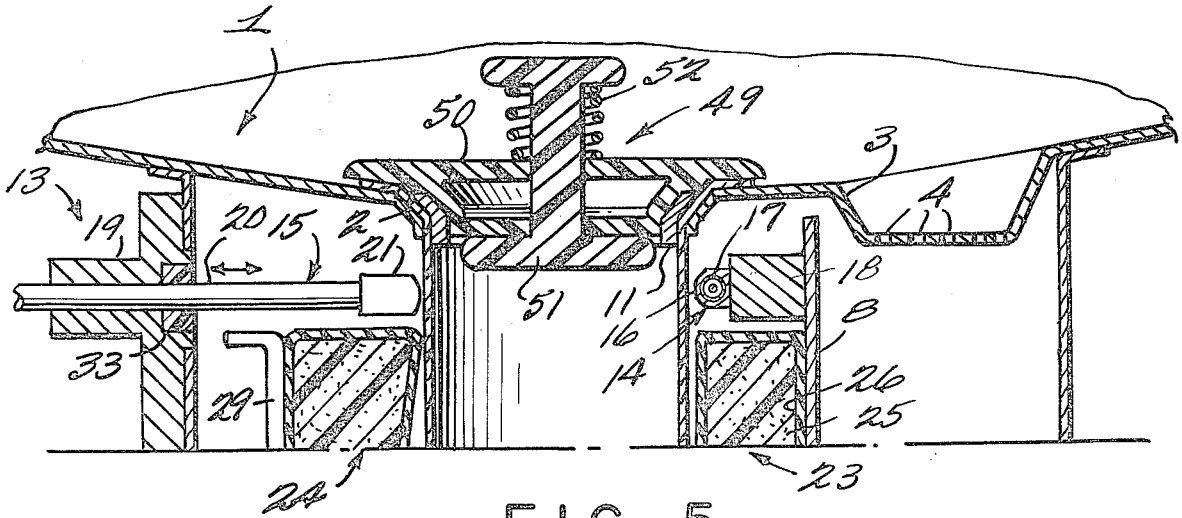

FIG. 5 shows a fifth embodiment of this invention. In this embodiment, a lid 50 of a compactor 49 is penetrated by presser plate 51 which is urged away from the opening of pliable bag 10 by spring 52 and which is manually operated by pushing down on the portion of plate 52 which passes through lid 50. Then, pressing block 21 of sealer 13 will not strike presser plate 51 when sealer 13 is actuated.

Figure 6:
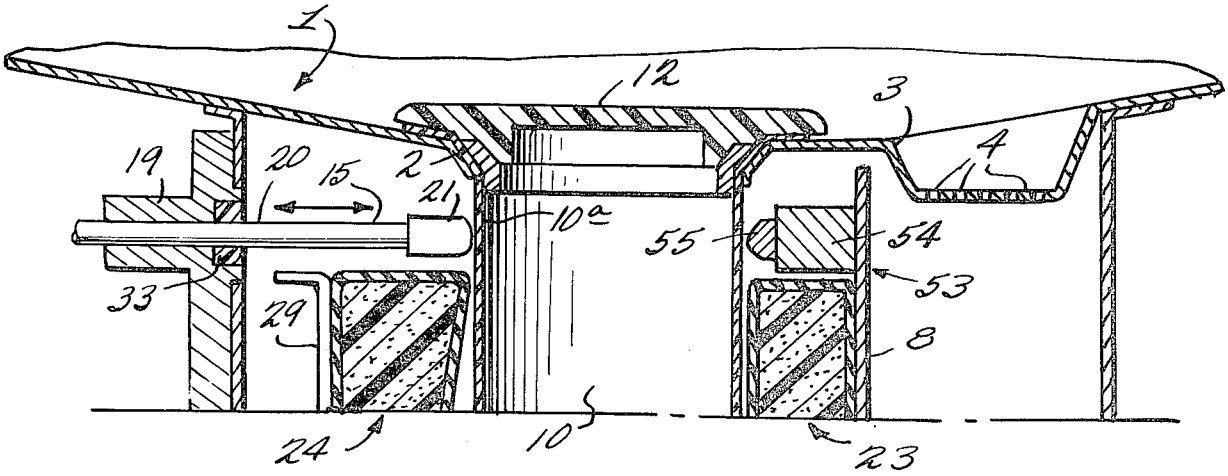

FIG. 6 shows a sixth embodiment of this invention. In this embodiment, sealer 53 comprises ultrasonic wave source means 54, a head 55 secured to source 54 and movable presser 15 for pressing the upper portion of pliable bag 10 into contact with source 54. In this embodiment, electric insulation is not necessary because no electric current flows in either pressing block 21 or head 55.

FIGS. 7 and 8 show a seventh embodiment of this invention. In these embodiments, sealer 56 consists of heater supporter 57 and sheathed electric heater 58 which is supported closely under hopper 1 and has a circular heating portion 58*a*. Pliable bag 10 has flanged portion 10*b* extending outwardly from top portion 10*a* and has cover 10*c* connected with a part of the flanged portion 10*b* by self-hinged portion 10*d*. Cover 10*c* has a same dimension as that of flanged portion 10*b*.

In this embodiment, pliable bag 10 is set with cover 10*c* open into opening 2 of hopper 1. Flanged portion 10*b* is supported by bag holder 11 and opening 2 is covered by lid 12. After washing, lid 12 is removed and cover 10*c* put on flanged portion 10*b* to cover the opening of pliable bag 10. Then electric heater 58 is energized, so that flanged portion 10*b* and cover 10*d* are sealed together.

FIG. 9 shows the eighth embodiment of this embodiment. In this embodiment, sealer 59 consists of casing 60 which is formed of the upper portion of frame 5, moter 61 mounted in casing 60, fan 62 which is rotated by moter 61 and heater 63 mounted in casing 60 in front of fan 62. Casing 60 has air intakes 64 near moter 61. Filter 65 is located in front of heater 63 for covering the opening of casing 60. Pliable bag 10 is made of heat shrink synthetic resin, e.g. vinyl chloride.

After the garbage is placed into bag 10, heater 63 is energized and fan 62 is rotated by moter 61 so that bag 10 is shrunk and compacted by the heated air.

FIG. 10 shows a pliable bag 10 adapted to the first to the sixth embodiment. Pliable bag 10 has flanged portion 10*b* which is suitable to hold pliable bag 10 between hopper 1 and bag holder 11.

Many modifications in the above described embodiment of the invention can be carried out without departing from the scope thereof. Accordingly, that scope is intended to be limited only by the scope of the appended claims.

What we claim is:

1. Refuse storage apparatus comprising:

a sink having an opening and an indented portion adjacent said opening having a plurality of drain holes therein;

a frame mounted to said sink beneath said opening and said indented portion to form a recess with a first section under said opening for receiving a pliable bag having a top and bottom with an opening at the top thereof and a drain hole at the bottom thereof, the top of said bag being supported by the edge of said opening so that refuse passing through said opening is received within said bag, and a second section under said indented portion having an opening adapted for connection to a drain hose so that liquid passing through said drain holes passes through said opening in said second section, said frame having a plate between said two sections with a perforation in the bottom thereof and the bottom of said frame being inclined so that liquid flows through said perforation to said opening in said second section;

first electric heater means mounted on said frame adjacent an upper portion of said bag and first movable pressing means for pressing said upper portion into contact with said first heater means for sealing said upper portion of said bag;

a trapezoidal-shaped flexible block mounted on said frame adjacent said bag for movement toward and away from said bag and for compacting refuse in said bag when movably advanced against said bag and pushing said refuse toward said bottom portion; and second electric heating means mounted on said frame adjacent said bottom portion of said bag and second movable pressing means for pressing said lower portion into contact with said second heater means for sealing said drain hole.

* * * * *